US009745171B2

(12) United States Patent
Husmann

(10) Patent No.: US 9,745,171 B2
(45) Date of Patent: Aug. 29, 2017

(54) SAFETY BRAKE FOR AN ELEVATOR INSTALLATION

(71) Applicant: Inventio AG, Hergiswil (CH)

(72) Inventor: Josef Husmann, Lucerne (CH)

(73) Assignee: INVENTIO AG, Hergiswil (CH)

( * ) Notice: Subject to any disclaimer, the term of this patent is extended or adjusted under 35 U.S.C. 154(b) by 77 days.

(21) Appl. No.: 14/651,838

(22) PCT Filed: Dec. 5, 2013

(86) PCT No.: PCT/EP2013/075730
§ 371 (c)(1),
(2) Date: Jun. 12, 2015

(87) PCT Pub. No.: WO2014/090689
PCT Pub. Date: Jun. 19, 2014

(65) Prior Publication Data

US 2015/0321883 A1 Nov. 12, 2015

(30) Foreign Application Priority Data

Dec. 13, 2012 (EP) ..... 12196968

(51) Int. Cl.
*B66B 5/20* (2006.01)

(52) U.S. Cl.
CPC ..... *B66B 5/20* (2013.01)

(58) Field of Classification Search
CPC ..... B66B 5/20; B66B 5/24
USPC ..... 187/374
See application file for complete search history.

(56) References Cited

U.S. PATENT DOCUMENTS 6,176,350 B1 * 1/2001 Schlosser ..... B66B 5/20 187/359
6,659,230 B1 * 12/2003 Jenkins ..... B66B 5/20 187/202
9,169,104 B2 * 10/2015 Legeret ..... B66B 5/20
2004/0112683 A1 * 6/2004 Liebetrau ..... B66B 7/046 187/372
2007/0007083 A1 * 1/2007 Husmann ..... B66B 5/20 187/366
2011/0226560 A1 * 9/2011 Husmann ..... B66B 5/18 187/359

(Continued)

FOREIGN PATENT DOCUMENTS

CN 101808926 A 8/2010
DE 19850678 C1 3/2000

(Continued)

*Primary Examiner* — Michael Riegelman
(74) *Attorney, Agent, or Firm* — Shumaker, Loop & Kendrick, LLP; William J. Clemens

(57) ABSTRACT

In an elevator installation an elevator car is movable along at least two guide rails and the car is equipped with a pair of safety brakes and an actuator for actuating the safety brakes. Each safety brake includes at least one brake eccentric with a cylindrical bearing bore and a brake housing with a bearing axle for mounting the brake eccentric. The bearing axle is arranged in the brake housing together with the brake eccentric to be pivotable or displaceable so that the brake eccentric, which is arranged on the bearing axle, in a first position can be kept at a spacing from a brake web of the guide rail and in a second position can be brought into contact with the brake web.

14 Claims, 4 Drawing Sheets

(56) References Cited

U.S. PATENT DOCUMENTS

| | | | | |
|---|---|---|---|---|
| 2012/0152658 | A1* | 6/2012 | Osmanbasic | B66B 5/044 187/288 |
| 2013/0081907 | A1* | 4/2013 | Meierhans | B66B 5/20 187/359 |
| 2013/0081908 | A1* | 4/2013 | Meierhans | B66B 5/20 187/359 |
| 2013/0133984 | A1 | 5/2013 | Osmanbasic et al. | |
| 2013/0248298 | A1* | 9/2013 | Osmanbasic | B66B 5/20 187/359 |
| 2014/0326544 | A1* | 11/2014 | Husmann | B66B 5/18 187/359 |
| 2014/0332324 | A1* | 11/2014 | Husmann | B66B 5/20 187/359 |

FOREIGN PATENT DOCUMENTS

| | | | |
|---|---|---|---|
| EP | 2112116 | A1 | 10/2009 |
| EP | 11183387 | * | 9/2011 |
| EP | 11192831 | * | 12/2011 |
| WO | 2011113753 | A2 | 9/2011 |

* cited by examiner

SAFETY BRAKE FOR AN ELEVATOR INSTALLATION

FIELD

The invention relates to a safety brake for braking an elevator car and an elevator installation with a safety brake of that kind.

BACKGROUND

The elevator installation is installed in a building. It substantially consists of a car which is connected by way of support means with a counterweight or with a second car. The car is moved, substantially vertically, along guide rails by means of a drive which selectably acts on the support means, directly on the car or on the counterweight. The elevator installation is used in order to convey persons and goods within the building over individual or several floors.

Elevator installations of that kind include devices in order to secure the elevator car in the event of failure of the drive or the support means or if need be also to safeguard it, in the case of a stop at a floor, from undesired drifting away. For that purpose use is usually made of safety brakes which when required can brake the elevator car on the guide rails. In that case, increasing preference is given to safety brakes which can be activated by an electronic monitoring system.

A brake device which can be electromagnetically activated is known from WO 2011/113753. In that case, after adjustment of a brake shoe with respect to a brake web has been carried out and when the elevator car is moving, the brake shoe is rotated and longitudinally displaced. The brake shoe can thereby build up a braking force and brake the car.

SUMMARY

The solution illustrated in the following has the purpose of providing an alternative braking device or safety brake which is equally suitable for attachment to an elevator car and which can produce braking of the elevator car. The safety brake shall be actuable in simple manner and be able to be reset again in simple manner.

A proposed safety brake consists of a brake housing which is shaped to hold essential parts of the safety brake. In that case the brake housing does not have to enclose these parts. The brake housing can also be a base plate on which the essential parts are arranged. This brake housing is constructed in order to be able to accept essential clamping forces and arising braking forces. The brake housing includes connections for fastening of the safety brake to an elevator car. The safety brake is suitable to brake or hold the elevator car at a brake web. For that purpose a brake eccentric with a cylindrical bearing bore is arranged at or in the brake housing. This brake eccentric is carried by a bearing axle, wherein this bearing axle is arranged in the brake housing to be pivotable or displaceable. The brake eccentric arranged on the bearing axle can in a first position be kept at a spacing from the brake web and can in a second position be brought into contact with the brake web. Thus the brake eccentric can on the one hand be held in a neutral, non-braking setting at a spacing from the brake web and can on the other hand, in the case of braking being required, be brought into contact with the brake web.

The brake housing preferably has a passage through which the bearing axle projects and a first device moves or draws the brake eccentric together with the bearing axle into the first position. This first position is in that case determined by, for example, an end stop of the passage. As a rule, one rigid stop is sufficient which is formed by, for example, a passage in the form of a slot. The slot can in that case preferably take over guidance of the bearing axle. This is advantageous since the passage can thereby accept substantial forces arising during braking.

The bearing axle is preferably arranged in the brake housing to be pivotable about a vertical axis. The bearing axle is, for example, mounted in a rear part of the brake housing about the vertical axis. Forces which arise can thereby be introduced in simple manner into the brake housing, since an increasing distance between the vertical axis and the end stop produces a reduction in opposing forces.

The first device for moving the brake eccentric into the first position is preferably a spring or a spring mechanism, wherein this draws the brake eccentric into the first position defined by the end abutment of the passage. This is advantageous, since the spring on the one hand draws back the brake eccentric, insofar as this is not clamped or actuated, into the first position and on the other hand influences an actuation force for adjusting the brake eccentric towards the brake web in a precisely defined, calculable order of magnitude. It is also of advantage that the spring or spring mechanism is resilient. Thus, in the case of, for example, faulty brushing of the brake eccentric against the brake web this is not engaged, but a relevant definable pressing pressure is required in order to rotate the brake eccentric. Faulty actuation of the safety brake is thus precluded.

The brake web is preferably a component of a guide rail and the safety brake co-operates with this brake web for the purpose of braking the elevator car. The safety brake preferably additionally comprises a brake member which is arranged opposite the brake eccentric in or at the brake housing so that the brake web of the guide rail can, when required, be clamped between the brake eccentric and the brake member. For that purpose the brake eccentric, when it is brought into contact with the brake web by the second device, is so rotated by a relative movement between brake web and safety brake that it is pushed back into the first position. The shape of the brake eccentric is in that case such that a spacing from the outer contour thereof to the center of the cylindrical bearing bore constantly increases in the direction of rotation. The brake eccentric is thereby initially urged back until it is again at the end stop of the passage. Thereafter, or substantially simultaneously, through further rotation of the brake eccentric the bearing axle together with the brake housing is displaced so that ultimately the brake member similarly contacts and clamps the brake web. The brake housing is for that purpose preferably resiliently mounted, for example on slide rods, to be laterally displaceable. The slide rods can in that case transmit an arising braking force to, for example, the elevator car. The end stop of the passage, preferably a slot, in that case takes over and in that case transmits a pressing force produced by the brake eccentric and transfers this force to the brake housing. It is particularly advantageous that in the case of use of a pivotable bearing axle the brake eccentric is set at an inclination merely by pressing against the brake web in the context of the required pivotation and that the brake eccentric when urged back against the end stop again passes into a work setting planar with respect to the brake web. The brake eccentric and the bearing axle can thereby be loaded in ideal manner.

The bearing axle is preferably fixedly connected with an actuating lever. The actuating lever is in that case, for example, screw-connected with, welded to or connected by means of bolts with the bearing axle. In every case the connection is such that the bearing axle can be pivoted by the actuating lever about the vertical axis. The brake eccentric can thereby be brought by the actuating lever into contact with the brake web. An adjusting force is so dimensioned that on the one hand a return force of the first device can be reliably overcome and in addition there is a force excess which suffices in order to press the brake eccentric so strongly against the brake web that it can be reliably rotated by the relative movement between brake web and safety brake. An adjusting force of that kind lies, for example, in an order of magnitude of 150 to 700 Newtons, preferably 500 to 600 Newtons. Conventional brake eccentrics provided with a milling or grooving are reliably rotated by this adjusting force.

For preference, the actuating lever can, when required, be pivoted by an actuator, such as described in, for example, specification WO 2011/113753, so that the actuating lever can bring the brake eccentric into contact with the brake web.

A mounting plate is preferably used in order to secure the brake eccentric on the bearing axle. The bearing axle is for that purpose provided with an abutment collar, possibly with an appropriate thrust washer, by means of which a position of the brake eccentric on the bearing axle is determined. Assembly of the safety brake is thereby made possible in simple manner. For example, the bearing axle can be fastened in a part of the brake housing at the rear side to be pivotable. The actuating lever can be fastened to the bearing axle before, after or together with the bearing axle. The brake eccentric, possibly with an integrated bearing slide bush, is subsequently placed on the bearing axle and secured on the bearing axle by means of the mounting disc. The mounting plate covers the bearing bore and it is preferably fastened to the bearing axle by a screw pair.

The spring mechanism of the first device for drawing the brake eccentric into the first position preferably comprises a pull lever, a rocker and at least one spring. The pull lever and the rocker are pivotably connected together, wherein the pull lever is connected with the brake eccentric and the rocker is pivotably mounted in the brake housing. The fastening of the pull lever to the brake eccentric is in that case such that an inclined setting, which arises on pivotation of the bearing axle, of the brake eccentric can be taken up. The spring in addition acts on the rocker in such a way that it draws the brake eccentric into the first position by way of the pull lever. A force increase in the return force can be idealized by way of the rocker and the arrangement of the spring and, moreover, the rocker can simply actuate a switch when it reaches a tilt setting corresponding with a braking setting of the brake eccentric. Monitoring of the safety brake is thus possible in simple manner and a control can thereby similarly actuate, for example, a second safety brake if a first safety brake erroneously comes into braking action. Braking at one side is thus prevented.

The spring mechanism preferably additionally includes a detent setting which secures the brake eccentric in the first position against unintended pivotation. The detent setting can be a ball catch or similar. Oscillation of the brake eccentric is thus precluded.

DESCRIPTION OF THE DRAWINGS

The invention is explained in the following by way of example on the basis of an embodiment in connection with the figures, in which.

In the figures, the same reference numerals are used across all figures for equivalent parts.

DETAILED DESCRIPTION

Figure 1:
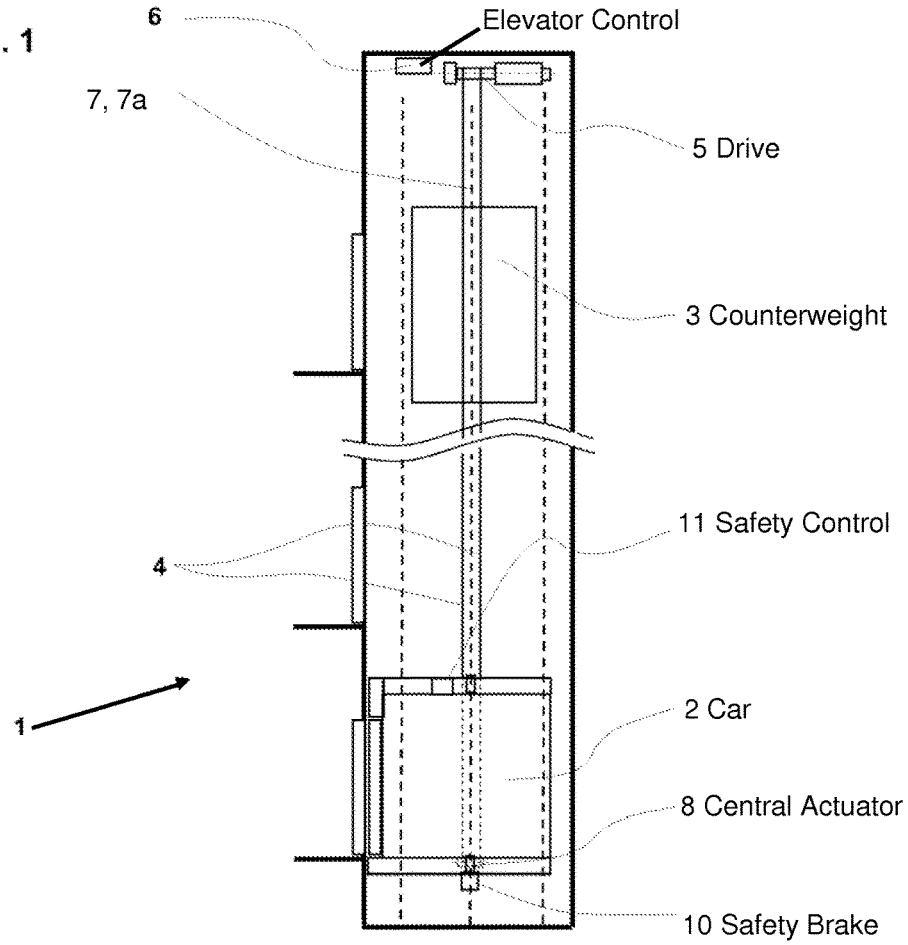
FIG. 1 shows a schematic view of an elevator installation.

FIG. 1 shows an elevator installation 1 in an overall view. The elevator installation 1 is installed in a building and serves for transport of persons or goods within the building. The elevator installation comprises an elevator car 2 which can move upwardly and downwardly along guide rails 7. The elevator car 2 is accessible from the building by way of doors. A drive 5 serves for driving and holding the elevator car 2. The drive 5 is arranged in the upper region of the building and the car 2 hangs by support device or means 4, for example support cables or support belts, at the drive 5. The support means 4 are guided over the drive 5 onward to a counterweight 3. The counterweight compensates for a mass component of the elevator car 2 so that the drive 5 for the main part merely has to provide compensation for an imbalance between car 2 and counterweight 3. In the example, the drive 5 is arranged in the upper region of the building. It can obviously also be arranged in the region of the car 2 or counterweight 3.

Figure 2:
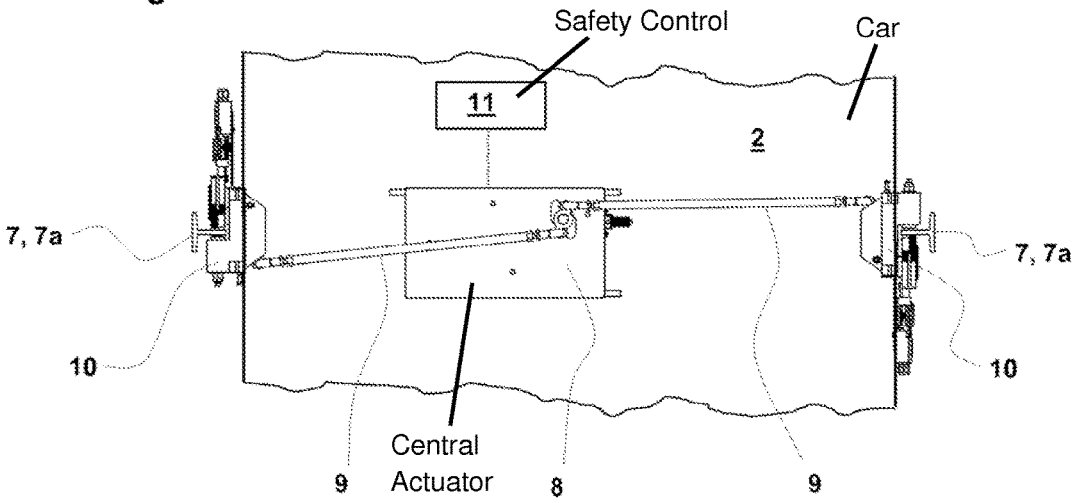
FIG. 2 shows a pair of safety brakes, attached to an elevator car.

The elevator car 2 is equipped with a safety brake 10 suitable for securing and/or retarding the elevator car 2 in the case of an unexpected movement, in the case of excess speed or in the case of a stop. In the example, the safety brake 10 is arranged below the car 2. The elevator installation 1 additionally comprises a safety control 11 which, in the example, is arranged at the elevator car 2. The safety control 11 monitors movements of the elevator car 2 and activates, when required, the safety brake 10. In the present example—see FIG. 2—two safety brakes 10 (or a pair of safety brakes 10) are arranged on the left and right of the elevator car 2 where they co-operate with guide rails 7 when required. In the example, the pair of safety brakes 10 is actuated by a central actuator 8 which is in turn activated by the safety control 11. The actuator 8 is connected with the safety brakes 10 by means of connecting rods 9, preferably pull rods.

In the embodiment illustrated in FIGS. 3 to 8 the safety brake 10 consists of a brake housing 17. The brake housing is constructed as a load-bearing structure. It is connected with the elevator car 2 by way of at least one slide rod 34 and by way of tilt abutments. The brake housing 17 is, for example, produced as a cast part, as a welded construction or from another mechanically processed structure. It is designed to accept required braking and pressing forces and to transmit these to the elevator car 2. The brake housing 17 is, for example, held in a basic position, which is defined by an abutment screw 17*a*, by way of a spring arrangement (not illustrated) on the slide rod 34. In the case of actuation of the safety brake 10 the brake housing 17 can thus laterally orientate with respect to the brake web 7*a* of the guide rail 7.

A bearing axle 18 is arranged in the brake housing 17. This is arranged in the brake housing 17 to be pivotable about a vertical axis 27*a*. A brake eccentric 15 is arranged on a front part of the bearing axle 18 by way of a bearing shell 26. The brake eccentric has for that purpose a cylindrical bearing bore 16 and the bearing axle 18 includes, preferably, a collar against which the brake eccentric can abut. The brake eccentric 15 additionally has, starting from a center region, an external cam shape which rises in both directions of rotation and which ends in a brake surface with a straight section. The brake housing has, in the region between brake eccentric 15 and the vertical axis 27*a*, a passage 24, preferably a slot, through which the bearing axle 18 can project.

The passage 24 includes an end stop 24*a* against which the bearing axle 18 can stand and which is so arranged that the brake eccentric can be arranged substantially perpendicularly to the brake web 7*a* or that a contact surface of the brake eccentric is planar with respect to the brake web. The passage 24 is formed in such a way that it enables adjustment of the brake eccentric 15 with respect to the brake web 7*a*. The adjustment corresponds with at least twice the amount of a play between brake surfaces and brake web. The adjustment is, for example, approximately 3 to 8 millimeters. The passage 24 is preferably shaped so that it guides the bearing axle 18 in a vertical direction so that braking forces and pressing forces can be transmitted by way of the end stop 24*a* of the passage 24.

The brake eccentric 15 is secured on the bearing axle 18 by a mounting plate 29. The mounting plate 29 is, for example, screw-connected with an end surface of the bearing axle. The brake eccentric 15 can obviously also be retained by a clamping or securing ring.

In the example, the bearing axle is provided with an actuating lever 27. The actuating lever 27 is so connected with the bearing axle 18 by a bearing pin of the vertical axis 27*a* and a bolt 27*c* that an actuating force introduced into the actuating lever 27 can pivot the bearing axle 18 about the vertical axis 27*a*. The actuating lever 27 is connected by means of a connecting point 27*b* with the connecting rod 9, preferably in the form of pull or push rods. The connecting rods 9 are, as explained in connection with FIG. 2, connected with an actuator 8. In the examples of FIGS. 3 to 8, the connecting rod 9 is provided with a length adjustment 9*a* so that a desired position of the bearing axle 18 can be precisely set. For preference, one of the connections from the actuator 8 to the pivotable axle 18 can be executed with play or a resilient coupling. Compensation for inaccuracies or forces which can arise, for example, during resetting can thus be provided.

The safety brake includes a brake member 23 which is so arranged opposite the brake eccentric 15 in the brake housing 17 that the brake web 7*a* can be disposed between the brake eccentric 15 and the brake member 23. The brake member is supported in the brake housing 17 by means of compression springs 23*a*, preferably biased compression springs 23*a*. The brake member 23 can for that purpose be biased relative to the compression springs 23*a* by means of spring pins 23*b* and setting nuts 23*c*.

Figure 3:
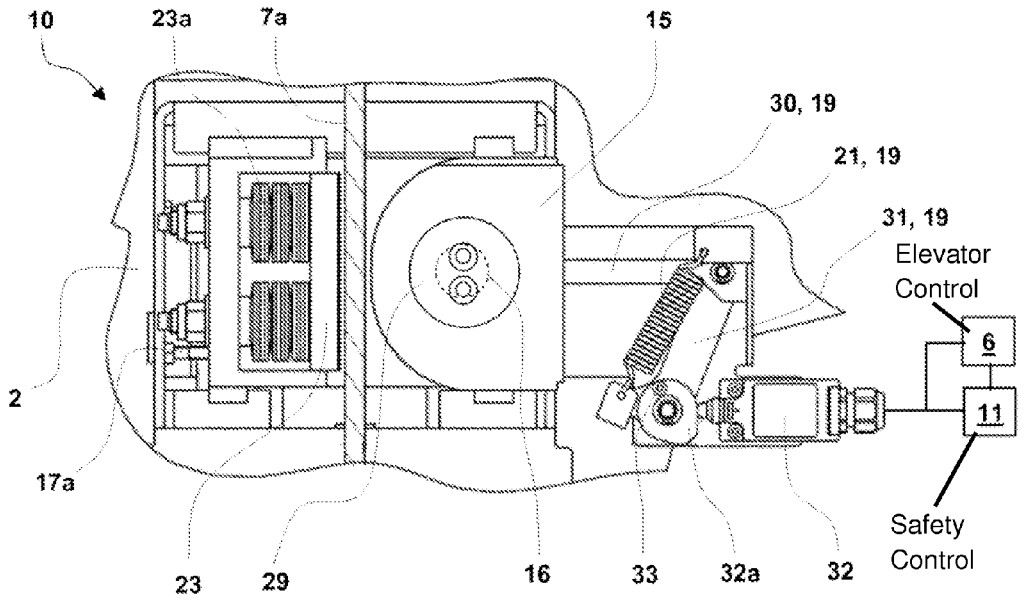
FIG. 3 shows a safety brake in a first, unactuated position.
Figure 4:
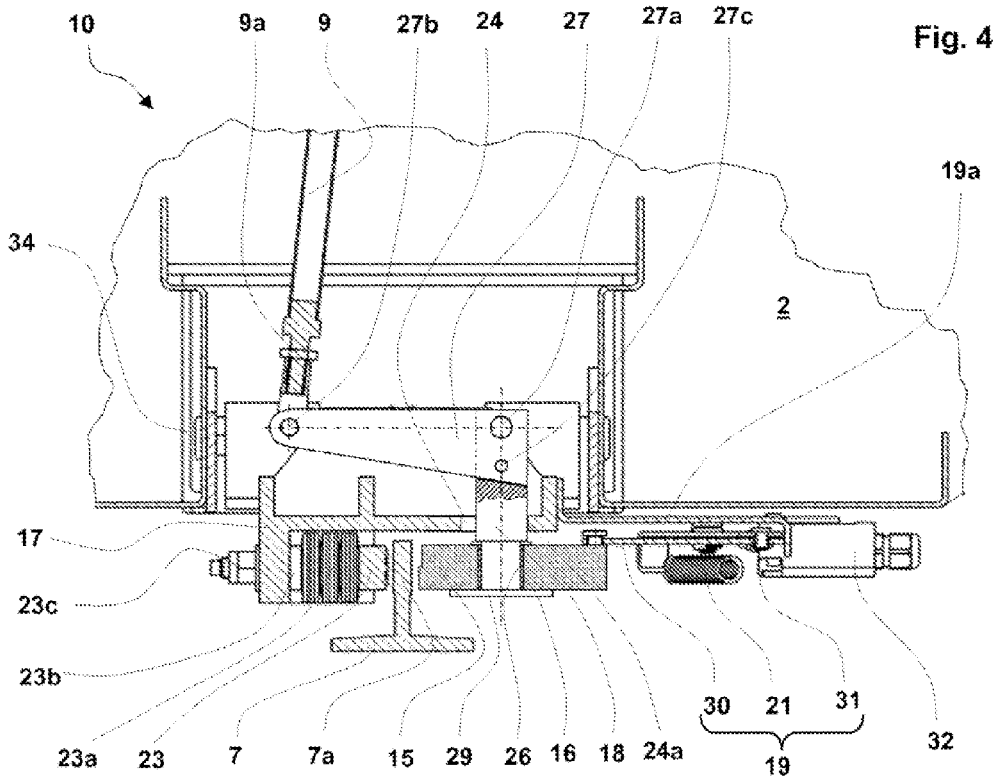
FIG. 4 shows the safety brake of FIG. 3 in a horizontal section.

The brake eccentric is, in addition, held by means of a first device 19 in a first position, as is illustrated in FIGS. 3 and 4. A pull lever 30 fastened to the brake eccentric is connected with a rocker 31, which is in turn pivotably mounted in a mounting plate 19*a* fastened to the brake housing 17. The rocker 31, therewith the pull lever 30 and ultimately the brake eccentric 15 together with the bearing axle 18, are thus held in the first position, in which case they are drawn against the end stop 24*a* of the passage 24. A position of the rocker 31 and thus a position of the brake eccentric 15 are monitored by means of a switch cam 32*a* by a switch 32. In the first position, which is illustrated in FIGS. 3 and 4, the brake eccentric is in its center position. It is spaced from the brake web 7*a*, and the brake housing 17 is located at an end position defined by the abutment screw. The safety brake 10 and therefore the elevator car 2 can thus move freely. The switch 32 is in an unactuated switch setting and this signal is, if required, passed on to the safety control 11 or also to the elevator control 6. A detent setting 33, for example in the form of a ball catch, is optionally integrated, in the illustrated solution, in the switch cam 32*a*. This provides an additional holding force which holds the brake eccentric in the first position. A restraining force of the spring 21 can be selected to be correspondingly smaller. The detent setting can also be arranged at, for example, the brake eccentric 15.

Figure 5:
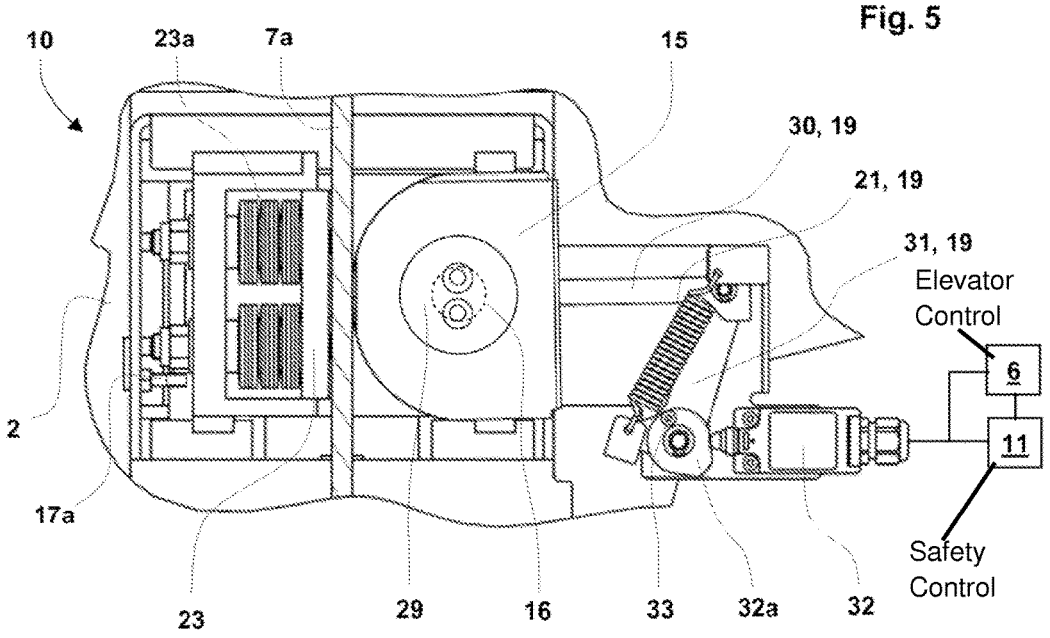
FIG. 5 shows a safety brake in a second, actuated position.
Figure 6:
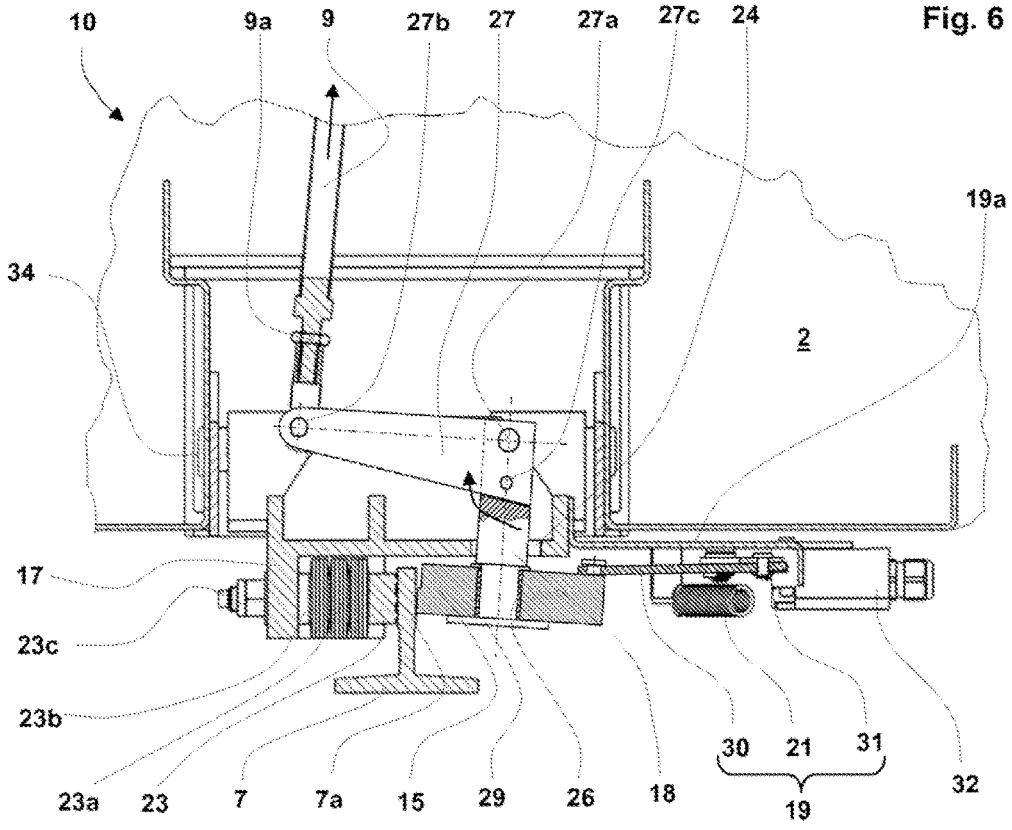
FIG. 6 shows the safety brake of FIG. 5 in a horizontal section.

In FIGS. 5 and 6 the safety brake 10 is actuated. The connecting rod 9 draws the actuating lever 27 and thus pivots the bearing axle 18 and the brake eccentric in the direction of the brake web 7*a* into a second position. The brake eccentric 15 is thereby adjusted towards the brake web and the brake housing is pulled tight on the slide rod 34 relative to the brake web so that the brake web is clamped between the brake eccentric 15 and brake member 23. The brake eccentric is in that case inclined in correspondence with a pivotation of the bearing axle 18. A connection of the pull lever 30 with the brake eccentric 15 is executed with lateral play in such a way that the pull lever 30 can be similarly inclined relative to the brake eccentric 15 or that it does not jam. However, a contact surface of the brake eccentric 15, which during adjustment is first to come into contact with the brake web 7*a*, can be rounded or chamfered at an inclination.

Figure 7:
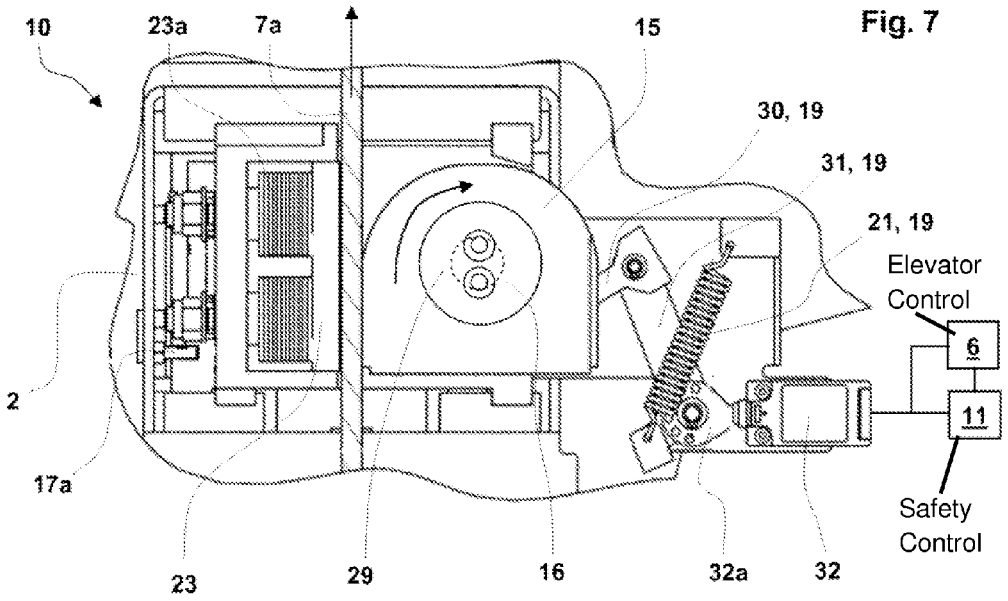
FIG. 7 shows a safety brake in a braking position.
Figure 8:
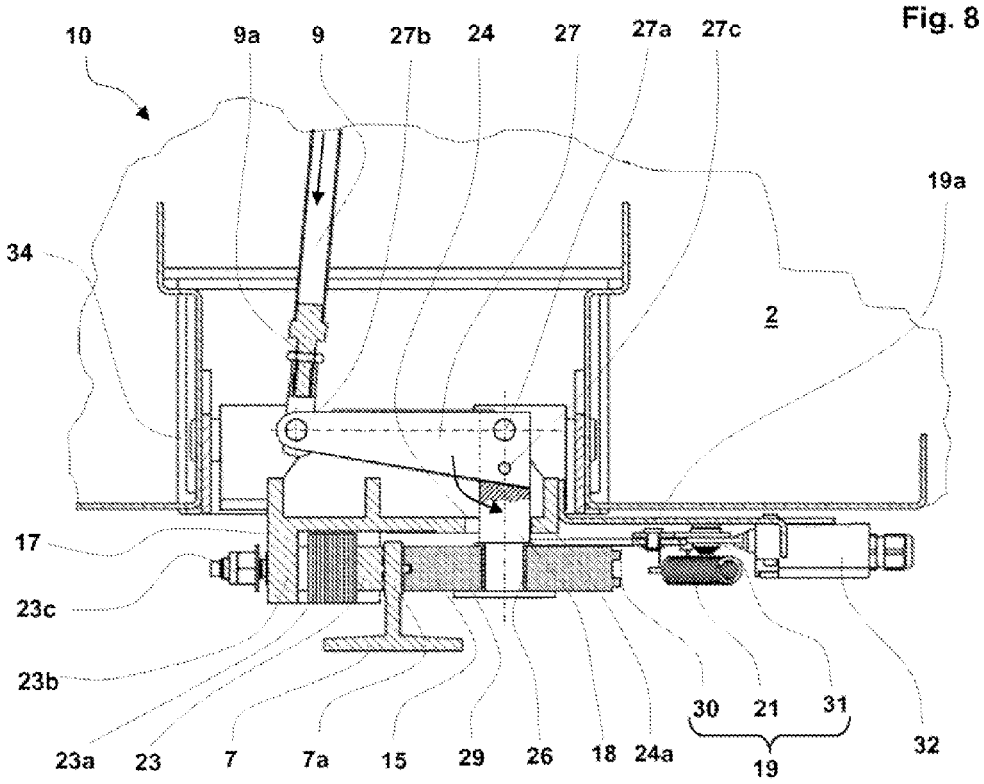
FIG. 8 shows the safety brake of FIG. 7 in a horizontal section.

If the safety brake 10 now moves downwardly in relation to the brake web 7*a* the brake eccentric 15 is rotated in clockwise sense as is apparent in FIGS. 7 and 8. The brake eccentric 15 accordingly urges the brake housing back again and stresses the compression springs 23*a* of the brake member 23. In that case also the brake eccentric is urged back, together with the bearing axle 18, towards the end stop 24*a*. The brake eccentric thereby again goes into a working position which is at right angles to the brake web 7*a* or, with regard to the contact surface from the brake eccentric with respect to the brake web 7*a*, planar. When the end stop 24*a* is reached a pressing force is significantly increased and a corresponding braking force is generated. The elevator car 2 is thus braked at the brake web 7*a*. Since a spacing from the vertical axis 27*a* of the bearing axle 18 to the passage 24 can be selected to be significantly greater than a spacing from the brake eccentric 15 to the passage 24 a reaction force on the vertical axis 27*a* can be kept low.

At the same time, the spring mechanism 19 was rotated by the rotating brake eccentric 15 and the switch 32 was actuated by the switch cam 32*a*. A safety circuit for the elevator control 6 is, for example, thereby interrupted and the safety control 11 can register the response of the safety brake.

At the same time, the actuating lever 27 and the connecting rods 9 were also moved back by urging back the brake eccentric 15; it indeed bears, together with the bearing axle 18, against the end stop 24*a*. As a result, for example, the actuator 8 or a force part of the actuator 8 can be stressed again.

For the purpose of resetting the safety brake merely the safety brake 10 or the elevator car 2 can now be moved back. The brake eccentric 15 is thereby rotated back. If the actuator 8 is activated at this point in time it can directly restrain the brake eccentric in the first position and the safety brake is reset into the first position illustrated in FIGS. 3 and 4.

The resetting can preferably also take place in accordance with a method as described in European Application EP 11191102.0 (see US Pub. No. 201310133984A1) of the same applicant.

The mode of functioning in opposite travel direction takes place analogously, wherein then the brake eccentric is rotated in the opposite direction.

With knowledge of the present invention the elevator expert can change the specified shapes and arrangements as desired. For example, instead of the spring mechanism 19 use can be made of any desired return device, for example merely a spring. Obviously, connecting means such as a pull cable or hydraulic actuating means can be provided instead of the pull or push rods 9. The pull cable could directly engage, possibly by way of deflecting rollers or a Bowden pull, the pivotable bearing axle 18. Alternatively, the bearing axle 18 can also be guided in the brake housing 17 by way of a longitudinal guide, such as a parallel guide or a guide carriage, so that the bearing axle 18 together with the brake eccentric 15 can be adjusted to be displaceable relative to the brake web 7*a*.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety brake for braking or holding an elevator car at a brake web comprising:

a brake eccentric having a cylindrical bearing bore; and a brake housing with a bearing axle mounting the brake eccentric, the bearing axle being arranged in the brake housing to be pivotable or displaceable with respect to the brake housing so that the brake eccentric in a first position is maintained at a spacing from the brake web and in a second position is brought into contact with the brake web, wherein the bearing axle is arranged in the brake housing to be pivotable about a vertical axis, the vertical axis being parallel with a length of the brake web.

2. The safety brake according to claim 1 wherein the brake eccentric is secured on the bearing axle by a mounting plate.

3. An elevator installation having the elevator car and at least one pair of the safety brakes according to claim 1 wherein the pair of safety brakes is actuated by a centrally arranged actuator and wherein the actuator acts on an actuating lever of each of the safety brakes by pulling or pushing.

4. The elevator installation according to claim 3 wherein the actuator is controlled by a safety control and the safety control in response to excess speed of the elevator car or in response to unintended movement of the elevator car from a stopping position activates the actuator to actuate the at least one pair of safety brakes.

5. A safety brake for braking or holding an elevator car at a brake web comprising:

a brake eccentric having a cylindrical bearing bore; and a brake housing with a bearing axle mounting the brake eccentric, the bearing axle being arranged in the brake housing to be pivotable or displaceable with respect to the brake housing so that the brake eccentric in a first position is maintained at a spacing from the brake web and in a second position is brought into contact with the brake web, wherein the brake housing has a passage through which the bearing axle projects and a first device for moving the brake eccentric together with the bearing axle into the first position and the first position is at an end stop of the passage.

6. The safety brake according to claim 5 wherein the first device for moving the brake eccentric into the first position includes a spring or spring mechanism that draws the brake eccentric into the first position at the end stop of the passage.

7. The safety brake according to claim 5 wherein the brake web is a component of a guide rail, the safety brake co-operates with the brake web for braking the elevator car and the safety brake further includes a brake member arranged at the brake housing opposite the brake eccentric to clamp the brake web between the brake eccentric and the brake member, wherein when the brake eccentric is brought into contact with the brake web in the second position, the brake eccentric together with the bearing axle are rotated by a relative movement between brake web and the safety brake back into the first position and the end stop of the passage accepts a pressing force generated by the brake eccentric and transmits the pressing force to the brake housing.

8. The safety brake according to claim 5 wherein the bearing axle is connected with an actuating lever and the actuating lever together with the bearing axle are pivotable about a vertical axis and the actuating lever is pivotable by an actuator together with the bearing axle to bring the brake eccentric into contact with the brake web.

9. The safety brake according to claim 5 wherein the first device includes a spring mechanism for drawing the brake eccentric into the first position, the spring mechanism including a pull lever, a rocker and a spring, wherein the pull lever and the rocker are pivotably connected together and wherein the pull lever is connected with the brake eccentric and the rocker is pivotably mounted in the brake housing, and wherein the spring acts on the rocker to draw the brake eccentric into the first position by way of the pull lever.

10. The safety brake according to claim 9 wherein the rocker actuates a switch when the rocker reaches a tilt setting corresponding with a braking setting of the brake eccentric.

11. The safety brake according to claim 9 wherein the spring mechanism includes a detent setting that secures the brake eccentric in the first position against unintended pivotation.

12. The safety brake according to claim 5 wherein the brake eccentric is secured on the bearing axle by a mounting plate.

13. An elevator installation having the elevator car and at least one pair of the safety brakes according to claim 5 wherein the pair of safety brakes is actuated by a centrally arranged actuator and wherein the actuator acts on an actuating lever of each of the safety brakes by pulling or pushing.

14. The elevator installation according to claim 13 wherein the actuator is controlled by a safety control and the safety control in response to excess speed of the elevator car or in response to unintended movement of the elevator car from a stopping position activates the actuator to actuate the at least one pair of safety brakes.

* * * * *